US009452313B2

(12) United States Patent
Thomas

(10) Patent No.: US 9,452,313 B2
(45) Date of Patent: Sep. 27, 2016

(54) WEIGHTLIFTING BAR IN WEIGHTLIFTING FRAME

(71) Applicant: Jeffrey Stewart Thomas, Fort Myers, FL (US)

(72) Inventor: Jeffrey Stewart Thomas, Fort Myers, FL (US)

( * ) Notice: Subject to any disclaimer, the term of this patent is extended or adjusted under 35 U.S.C. 154(b) by 0 days.

(21) Appl. No.: 14/623,909

(22) Filed: Feb. 17, 2015

(65) Prior Publication Data

US 2016/0236028 A1 Aug. 18, 2016

(51) Int. Cl.
*A63B 21/078* (2006.01)
*A63B 21/072* (2006.01)

(52) U.S. Cl.
CPC ..... *A63B 21/078* (2013.01); *A63B 21/072* (2013.01); *A63B 21/0783* (2015.10); *A63B 2021/0783* (2013.01)

(58) Field of Classification Search
CPC ..... A63B 21/078; A63B 21/0004; A63B 21/00058; A63B 21/00061; A63B 21/00065; A63B 21/06; A63B 21/062; A63B 21/0626; A63B 21/0632; A63B 21/072; A63B 21/0724; A63B 21/0728; A63B 21/0783; A63B 21/028
See application file for complete search history.

(56) References Cited

U.S. PATENT DOCUMENTS 3,640,529 A * 2/1972 Kane ..... A63B 21/023 482/129
4,216,959 A 8/1980 Niles
4,252,314 A 2/1981 Ceppo
4,256,301 A 3/1981 Goyette
4,306,715 A 12/1981 Sutherland
4,527,797 A 7/1985 Slade, Jr. et al.
4,635,930 A 1/1987 Cormier
4,934,693 A * 6/1990 Santoro ..... A63B 21/0626 482/104
4,955,603 A * 9/1990 Becker ..... A63B 21/0728 403/259
4,971,318 A * 11/1990 Tracy ..... A63B 21/0728 482/107
7,018,325 B2 * 3/2006 Shifferaw ..... A63B 21/0615 482/104
7,591,771 B2 * 9/2009 Rullestad ..... A63B 21/00181 482/104
2005/0054493 A1 3/2005 Skilken et al.
2006/0217244 A1 * 9/2006 Hudson ..... A63B 21/0728 482/93
2006/0252612 A1 * 11/2006 Melcer ..... A63B 21/078 482/94

(Continued)

OTHER PUBLICATIONS

Roguefitness, "Collars", Dec. 1, 2014 or earlier, www.roguefitness.com/weightlifting-bars-plates/collars.

(Continued)

*Primary Examiner* — Oren Ginsberg
*Assistant Examiner* — Megan Anderson
(74) *Attorney, Agent, or Firm* — George F. Wallace

(57) ABSTRACT

A weightlifting frame includes a base, and first and second rigid frame members defining respective vertically-oriented channels. A weightlifting bar includes first and second terminal sections, a middle section, first and second plate abutments fixed to the weightlifting bar, and first and second frame abutments fixed to the bar. First and second bar spaces are respectively defined by first and second plate and frame abutments. The bar engages the frame with the first frame member disposed between the first frame abutment and the first plate abutment, and with the second frame member disposed between the second frame abutment and the second plate abutment, such that the first and second frame abutments abut the first and second frame members when the bar reaches a predetermined angle from horizontal.

7 Claims, 4 Drawing Sheets

(56) References Cited

U.S. PATENT DOCUMENTS

| | | | | |
|---|---|---|---|---|
| 2007/0072750 | A1 | 3/2007 | Andrews | |
| 2010/0130335 | A1* | 5/2010 | Hoobler | A63B 21/078 482/104 |
| 2014/0287888 | A1 | 9/2014 | Jones et al. | |

OTHER PUBLICATIONS

Roguefitness, "Muscle Clamps", Dec. 1, 2014 or earlier, www.roguefitness.com/muscle-clamps?gc|id=C|SduaOUps|CFcRDMgodDy|A-A.

* cited by examiner

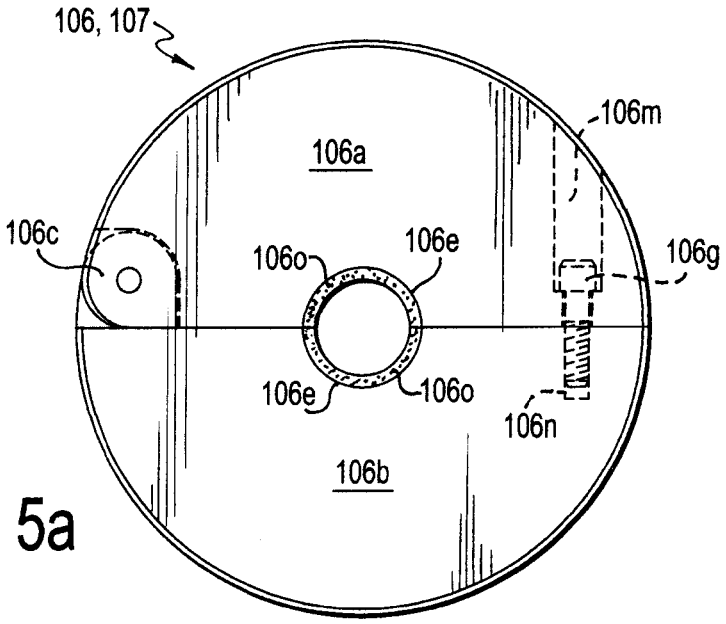
FIG. 5a
FIG. 5b
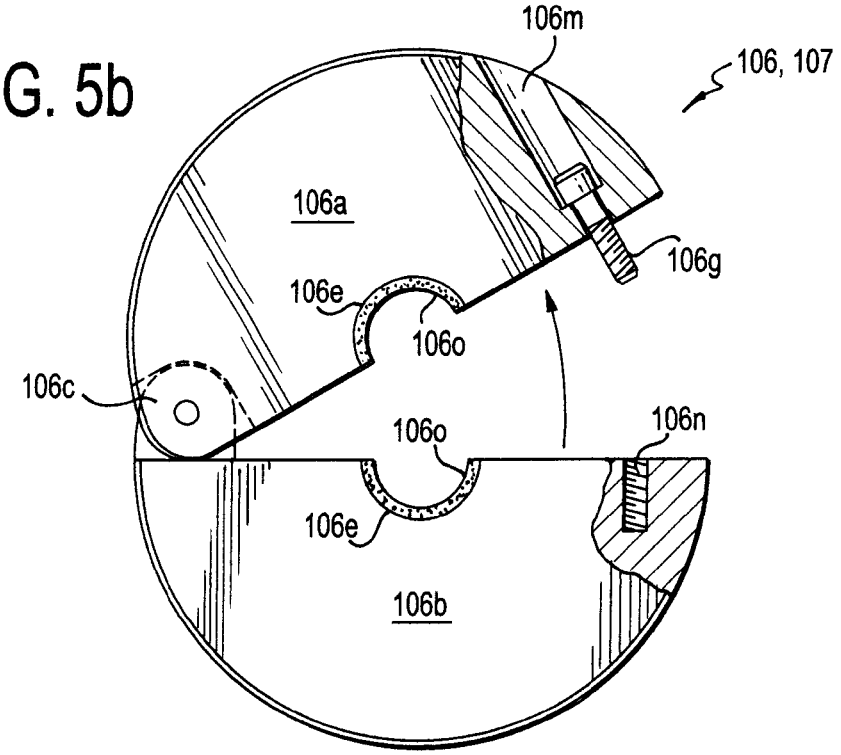

WEIGHTLIFTING BAR IN WEIGHTLIFTING FRAME

FIELD OF THE INVENTION

The present invention relates to weightlifting, and more specifically, to weightlifting bars used with weightlifting frames.

BACKGROUND OF THE INVENTION

Weightlifting is a form of physical exercise activity that provides users with resistance training. Common weightlifting devices include an elongated bar with weighted plates attached to ends of the bar, with the combination being lifted by a user to produce resistance.

Weightlifting frames can improve the safety of weightlifting sessions by limiting movement of a weightlifting bar along a linear path via a pair of opposing vertically aligned channels defined by a pair of rigid vertically aligned frames.

SUMMARY OF THE INVENTION

An object of the present invention is to provide weightlifting bar in weightlifting frame.

Another object of the present invention is to provide a weightlifting bar in weightlifting frame that overcomes at least one deficiency within the prior art.

In an exemplary environment of the present invention, a weightlifting frame can include a base connected to opposing first and second rigid frame members that respectively define respective vertically-oriented and opposing channels, through which a horizontally-oriented weightlifting bar can be disposed. Accordingly, the channels define the vertical movement of a bar so disposed, whilst limiting its horizontal movement during a weightlifting session.

In an exemplary embodiment of the present invention, a weightlifting bar can include first and second terminal sections having respective first and second plate diameters, with each terminal section being configured to engage at least one weight element; a middle section separated from said first and second terminal sections by respective first and second plate abutments fixed to the weightlifting bar; a first frame abutment securably fixed to said middle section and adjacent to the first plate abutment, with said first frame abutment and the first plate abutment defining a first bar space; and a second frame abutment securably fixed to said middle section and adjacent to the second plate abutment, with said second frame abutment and the second plate abutment defining a second bar space.

In an exemplary aspect of the present invention, the weightlifting bar engages the weightlifting frame with said middle section horizontally disposed between the first and second rigid frame members. Accordingly, the first frame member is disposed, within the first bar space, and between said first frame abutment and the first plate abutment; and the second frame member is disposed, within the second bar space, and between said second frame abutment and the second plate abutment. As such, said first and second frame abutments respectively abut the first and second frame members when the weightlifting bar reaches a predetermined angle from horizontal.

In another exemplary aspect of the present invention, said first and second frame abutments can be permanently fixed, or removably attached, to said middle portion.

In yet another exemplary aspect of the present invention, each frame abutment can include first and second portions, connected by a hinge, and pivotally moveable between open and closed positions.

In a further exemplary aspect of the present invention, the first and second portions can form a respective angle therebetween greater than 10 degrees when in the open state, and less than 10 degrees when in the closed state.

In still another exemplary aspect of the present invention, the first and second frame abutments can include respective first and second notches, which can form respective macro apertures when respectively in the closed state.

In still a further exemplary aspect of the present invention, when in the closed state, said middle section can be disposed within the respective macro apertures with said first and second frame abutments being immovably fixed to said middle section.

BRIEF DESCRIPTION OF THE DRAWINGS

FIG. 5*a* illustrates another exemplary frame abutment in a closed position.

FIG. 5*b* illustrates another exemplary frame abutment in an open position.

DETAILED DESCRIPTION

It should be noted that this disclosure includes a plurality of embodiments each having a plurality of elements and/or aspects, and such elements and/or aspects need not necessarily be interpreted as being conjunctively required by one or more embodiments of the present invention. In particular, all combinations of elements and/or aspects can enable a separate embodiment of a patentable invention, which may be claimed with particularity in this or any future filed Patent Applications. Moreover, such elements and/or aspects disclosed herein, whether expressly or implicitly, are to be construed strictly as illustrative and enabling, and not necessarily limiting. Therefore, it is expressly set forth that any elements and/or aspects, independently or in any combination of one of more thereof, are merely illustratively representative of one or more embodiments of the present invention and are not to be construed as necessary in a strict sense.

Further, to the extent the same element and/or aspect is defined differently anywhere within this disclosure, whether expressly or implicitly, the broader definition is to take absolute precedence, with the distinctions encompassed by the narrower definition to be strictly construed as optional.

Illustratively, perceived benefits of the present invention can include functional utility, whether expressly or implicitly stated herein, or apparent herefrom. However, it is expressly set forth that these benefits are not intended as exclusive. Therefore, any explicit, implicit, or apparent benefit from the disclosure herein is expressly deemed as applicable to the present invention.

The present invention provides a weightlifting bar in a weightlifting frame.

Figure 1:
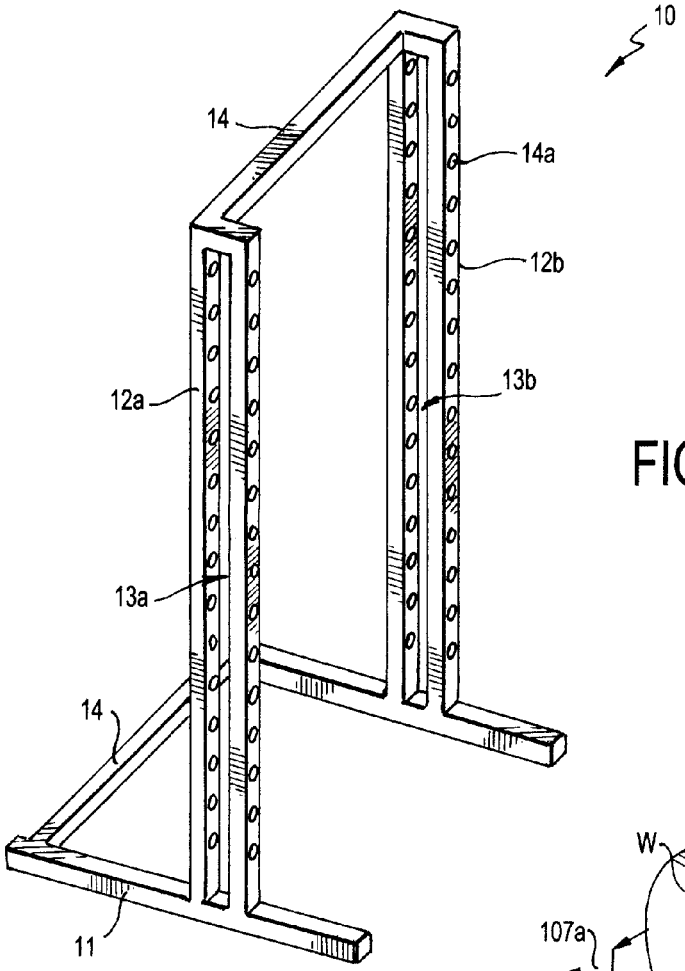
FIG. 1 illustrates an exemplary weightlifting frame having a base and first and second frame members.

As illustrated in FIG. 1, an exemplary weightlifting frame 10 includes a base 11 connected to opposing first and second rigid frame members 12*a*, 12*b* that respectively define respective vertically-oriented and opposing channels 13*a*, 13*b* through which a horizontally-oriented weightlifting bar (further described infra) can be disposed. Accordingly, channels 13*a*, 13*b* define the vertical movement of a bar so disposed, whilst limiting its horizontal movement (further described infra) during a weightlifting session. Notably, each portion of weightlifting frame 10 can be provided as one or more components to the extent desired and functionally compatible with the present invention.

In an exemplary aspect of the present invention, frame 10 can be formed from any one or more materials that provide sufficient strength to support anticipated stresses arising from weightlifting sessions. For example, and not in limitation, frame 10 can be formed from any one or more of a metal, plastic, rubber, synthetic, and naturally-occurring material. Further, frame 10 can be provided in any desired shape or shapes to the extent the same is functionally compatible with the present invention, and in particular, is not limited to the exemplary shapes illustratively shown herein.

In another exemplary aspect of the present invention, base 11 can be provided as any one or more structural components that provide first and/or second frame members 12*a*, 12*b* with sufficient stability to render the same self-standing on a surface, such as a floor or other form of structural support, for example and not in limitation. As illustratively shown in FIG. 1, base 11 can be provided as a single component having a "C" shape for connection to frame members 12*a*, 12*b* and for provisioning of side-to-side and front-to-rear stability. As further illustrated in FIG. 1, base 11 can optionally include at least one cross member 14 connected to both frame members 12*a*, 12*b* to provide frame 10 with additional stability. Notably, as illustrated in FIG. 1, cross member 14 can be connected to upper portions of frame members 12*a*, 12*b*, so as to provide clearance for a user; however, cross member can be connected at any portion of the frame members to the extent desired and functionally compatible with the present invention.

As further illustrated, frame members 12*a*, 12*b*, can optionally and respectively include a plurality of vertically-aligned adjustment holes 14*a* that extend through each respective member to allow an adjustment pin 14*b* to pass therethrough. Accordingly, by inserting a pin 14*b* through selected holes 14*a*, such a pin can act as a structural stop that would prevent a weightlifting bar from moving beyond the pin, which can provide improved functionality and/or safety.

Figure 2:
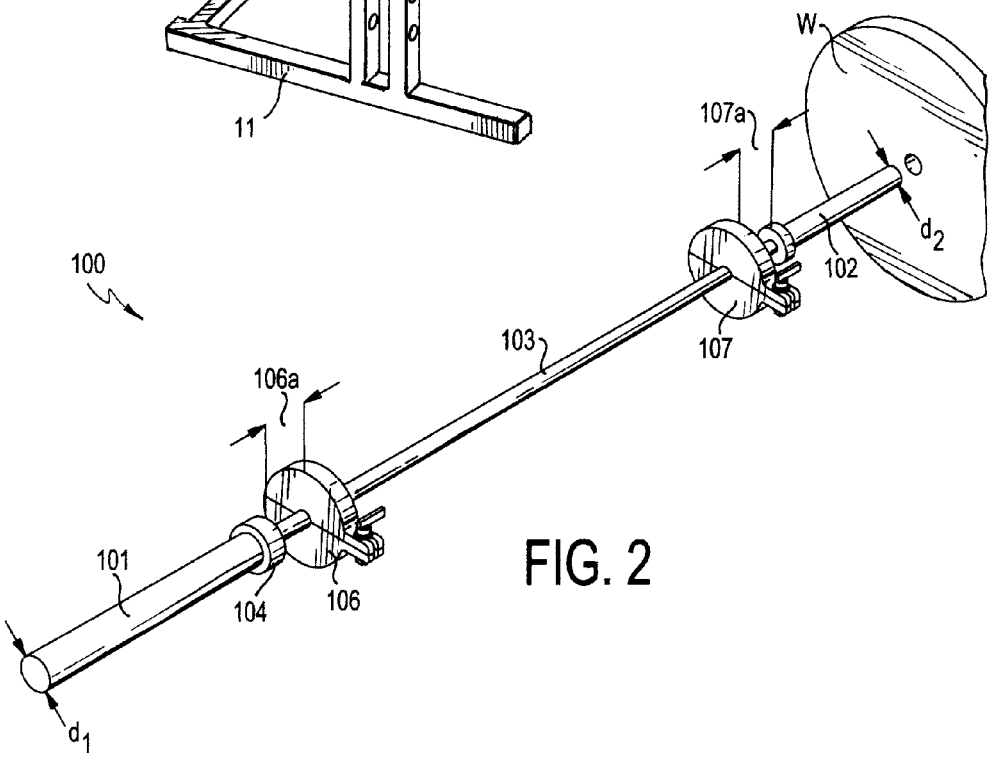
FIG. 2 illustrates an exemplary weightlifting bar having first and second terminal sections, a middle section, first and second plate abutments, and first and second frame abutments

FIG. 2 illustrates an exemplary weightlifting bar 100 according to the present invention, in which a bar can include first and second terminal sections 101, 102 having respective first and second plate diameters d1, d2, with each terminal section being configured to engage at least one weight element W. In an exemplary aspect, a common engagement configuration is for first and second plate diameters d1, d2 to be sized and/or shaped to pass through a centrally located hole within weight element W. However, the present invention anticipates any alternative engagement configuration that functionally engages a weight W with bar 100 to the extent desired and functionally compatible with the present invention.

As further illustrated, bar 100 further includes a middle section 103 separated from the terminal sections 101, 102 by respective first and second plate abutments 104, 105 fixed to the weightlifting bar. In an exemplary aspect of the present invention, middle section 103 can be provided for a user to grasp bar 100 with their hands, and plate abutments 104, 105 can be provided to prevent weights W from sliding or otherwise moving towards and contacting a user's hands, which can create an unsafe condition. Notably, plate abutments 104, 105 can be provided as separate structures that are fixed to bar 100, such as via welding, adhesive, clamp, or otherwise; or as integral components of bar 100, such as forming plate abutments via a molding process, for example and not in limitation.

As illustrated in FIG. 2, bar 100 can further include first and second frame abutments 106, 107 that are securably fixed to middle section 103. As with plate abutments 104, 105, frame abutments 106, 107 can be provided as separate structures and fixed thereto via welding, adhesive, clamp, or otherwise; or as integral components of bar 100. As further illustrated, first frame abutment 106 can be fixed adjacent to first plate abutment 104 to define a first bar space 106*a* therebetween; and second frame abutment 107 can be fixed adjacent to second plate abutment 105 to define a second bar space 107*a* therebetween.

Figure 3A:
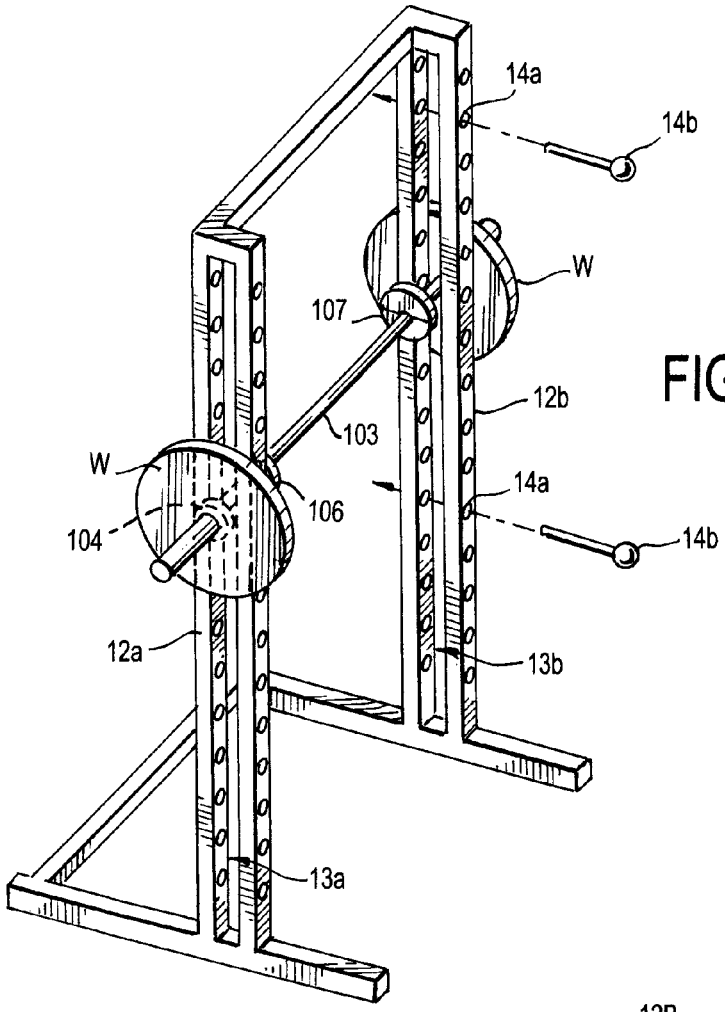
FIG. 3*a* illustrates an exemplary weightlifting bar horizontally engaged with an exemplary weightlifting frame.
Figure 3B:
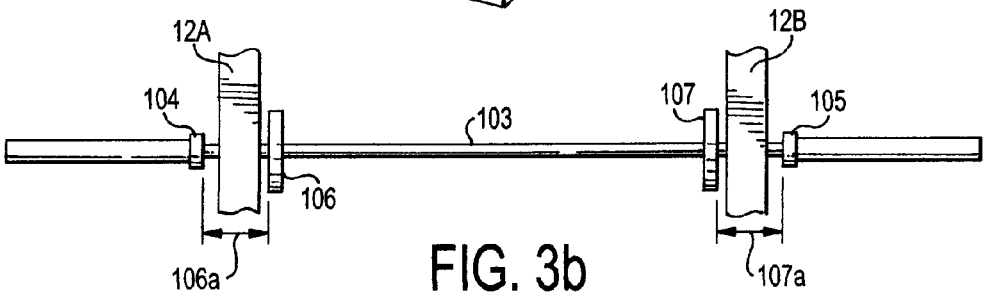
FIG. 3*b* illustrates exemplary orientation of plate and frame abutments engaged with first and second frame elements with a horizontally positioned weightlifting bar.
Figure 3C:
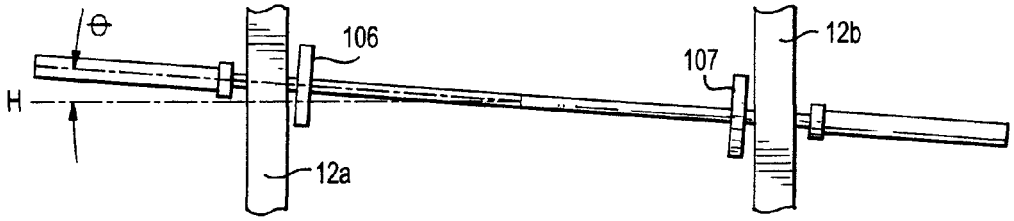
FIG. 3*c* illustrates exemplary orientation of plate and frame abutments engaged with first and second frame elements with a weightlifting bar deviating from a horizontal position.

As illustrated in FIGS. 3*a*-3*c*, an exemplary engagement of bar 100 with frame 10 can include middle section 103 being horizontally disposed between first and second frame members 12*a*, 12*b*. As such, first frame member 12*a* is disposed within first bar space 106*a*, which is between first frame abutment 106 and first plate abutment 104; and second frame member 12*b* is disposed within second bar space 107*a*, which is between second frame abutment 107 and second plate abutment 105. Accordingly, to the extent bar 100 remains at least generally horizontal, the bar can be raised and lowered between channels 13*a*, 13*b* without either plate abutment 104, 105 or either frame abutment 106, 107 contacting either frame member 12*a*, 12*b*. Notably, the relative positions of plate abutments 104, 105 and frame abutments 106, 107 define the size of bar spaces 106*a*, 107*a*, which in turn define the degree (θ) of deviation from horizontal (H) bar 100 can move before the first and second frame abutments respectively contact frame members 12*a*, 12*b*. Accordingly, first and second frame abutments 106, 107 define a maximum degree of deviation (θ) from horizontal that bar 100 can move. Notably, bar spaces 106*a*, 107*a* can be particularly selected to define any particular maximum degree of deviation from horizontal bar 100 can move. For example, and not in limitation, bar spaces 106*a*, 107*a* can be defined to prevent bar 100 from moving beyond 15° from horizontal.

Figure 4A:
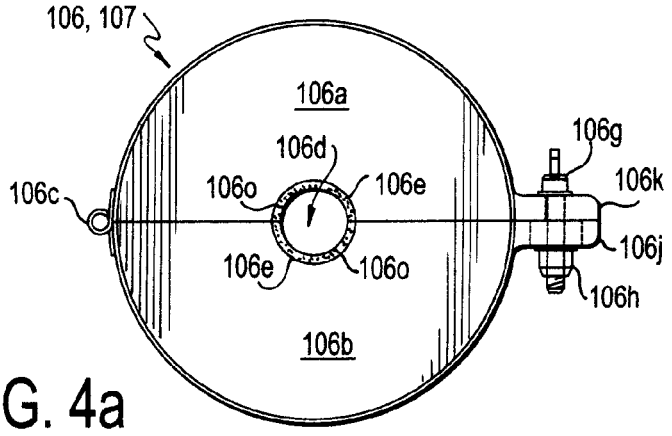
FIG. 4*a* illustrates an exemplary frame abutment in a closed position.
Figure 4B:
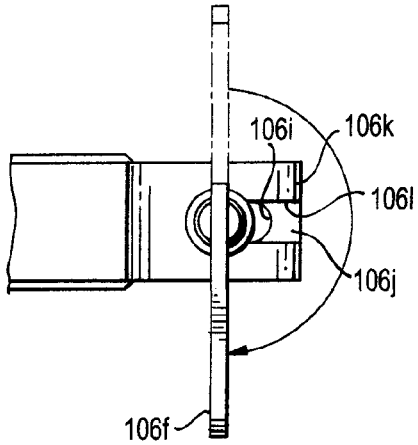
FIG. 4*b* illustrates an exemplary locking arrangement of a frame abutment.
Figure 4C:
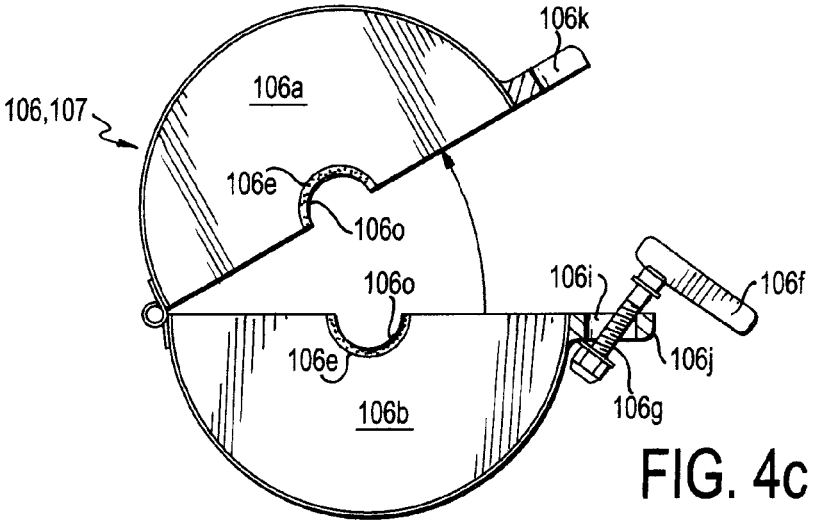
FIG. 4*c* illustrates an exemplary frame abutment in an open position.

FIGS. 4*a*-4*c* illustrate an exemplary frame abutment 106, 107 provided as a separate structure for fixation to bar 100 (not shown). As illustrated, frame abutment 106, 107 can include first and second portions 106*a*, 106*b* connected together via a hinge 106*c*, with each portion respectively including a notch 106*e*. As illustrated in FIG. 4*a*, when in the closed position, the respective notches 106*e* form a bar aperture (or macro aperture) 106*d* complementarily sized to engage bar 100 (not shown) so as to securably fix frame abutment 106, 107 to the bar. FIG. 4*b* illustrates an exemplary frame abutment 106, 107 in an open position, in which first and second portions 106*a*, 106*b* pivot open to expose notches 106*e* such that bar 100 (not shown) can be disposed therebetween prior to transitioning the frame abutment to a closed position and securely fixing the same to the bar. Optionally, notch 106*e* can be provided with a bar contact layer 106*e*, which can be formed of any desired material, such as a rubber, foam, or plastic, for example and not in limitation, to provide a compressible and/or slip-resistant function.

In an exemplary aspect, as further illustrated in FIGS. 4*a*-4*c*, first and second portions 106*a*, 106*b* can be locked together to maintain fixation of frame abutment 106, 107 to bar 100. In an exemplary embodiment, first and second portions 106*a*, 106*b* can respectively include first and second flanges 106*k*, 106*j* through which a bolt 106*g* can be disposed and engaged with a nut 106*h*. Accordingly, with first and second flanges 106*k*, 106*j* disposed therebetween, via handle 106*f*, bolt 106*g* and nut 106*h* can be tightened to relative positions that maintain frame abutment 106, 107 in the closed position and securely fixed to bar 100. In an exemplary aspect, as illustrated in FIGS. 4*b* and 4*c*, first flange 106*k* can include an open slot 106L, and second flange 106*j* can include an elongated slot 106*i*, such that bolt 106*g* can be pivoted away from, and clear, first flange 106*g*, such that first and second portions 106*a*, 106*b* can freely pivot to expose notches 106*e* without requiring disengagement of bolt 106*g* from nut 106*h*.

FIGS. 5*a* and 5*b* illustrate another exemplary frame abutment 106, 107. In an exemplary aspect, hinge 106*c* can be integral with frame abutment 106, 107. In another exemplary aspect, first portion 106*a* can include a collared bolt hole 106*m*, and second portion 106*b* can include a threaded bolt hole 106*n*, which collectively allow first and second portions 106*a*, 106*b* to be maintained in a closed position, and thus, securably fixed to bar 100 (not shown) via bolt 106*g* passing through collared bolt hole 106*m* and engaging threaded bolt hole 106*n*.

Notably, optionally, in the open state, first and second portions 106*a*,106*b* can form an angle therebetween greater than 15 degrees, and in the closed state, the first and second portions can form an angle therebetween less than 15 degrees.

In an exemplary aspect of the present invention, the present invention can be formed of any one or more materials that provide sufficient strength to be functionally compatible within the spirit of the present invention, such as, for example and not in limitation, any one or more of a metal, wood, crystalline, plastic, rubber, synthetic, and naturally-occurring material.

Notably, in any embodiment of the present invention, the various elements can be provided in any desired shape and/or size that are functionally compatible with the present invention, and are not limited to any particular shape or size illustratively described herein. Accordingly, exemplary shapes and/or sizes can include any shape or size having one or more geometric shapes, whether having symmetric or asymmetric portions, and without shape or size limitations relative to other elements unless necessary to the functionality of the present invention.

It will be apparent to one of ordinary skill in the art that the manner of making and using the claimed invention has been adequately disclosed in the above-written description of the exemplary embodiments and aspects.

It should be understood, however, that the invention is not necessarily limited to the specific embodiments, aspects, arrangement, and components shown and described above, but may be susceptible to numerous variations within the scope of the invention. For example, first and second portions 106*a*, 106*b* are illustratively shown as having a bolt-threaded aspect combination to secure the portions together, however, any one or more structural components can be utilized to achieve the same function, such as, for example and not in limitation, a clamp, strap, adhesive, etc., and further, can be positioned anywhere on first and second portions 106*a*, 106*b* that is functionally compatible with the present invention.

Therefore, the specification and drawings are to be regarded in an illustrative and enabling, rather than a restrictive, sense.

Accordingly, it will be understood that the above description of the embodiments of the present invention are susceptible to various modifications, changes, and adaptations, and the same are intended to be comprehended within the meaning and range of equivalents of the appended claims.

Therefore I claim:

1. In a weightlifting frame having a base connected to opposing first and second rigid frame members, the frame members each defining a respective vertically-oriented channel, an elongated and rigid weightlifting bar, comprising:

first and second terminal sections having respective first and second plate diameters, and each terminal section being configured to engage at least one weight element;

a middle section separated from said first and second terminal sections by respective first and second plate abutments fixed to the weightlifting bar;

a first frame abutment securably fixed to said middle section and adjacent to the first plate abutment, said first frame abutment and the first plate abutment defining a first bar space; and a second frame abutment securably fixed to said middle section and adjacent to the second plate abutment, said second frame abutment and the second plate abutment defining a second bar space;

wherein the weightlifting bar engages the weightlifting frame with the bar moveably disposed within the channels, and with said middle section horizontally disposed between the first and second rigid frame members, such that the first frame member is disposed, within the first bar space, and between said first frame abutment and the first plate abutment, and such that the second frame member is disposed, within the second bar space, and between said second frame abutment and the second plate abutment, such that said first and second frame abutments respectively abut the first and second frame members when the weightlifting bar reaches a predetermined angle from horizontal.

2. The bar of claim 1, wherein said first and second frame abutments are removably attached to said middle portion.

3. The bar of claim 2, wherein each of said first and second frame abutments includes first and second portions, connected by a hinge, and pivotally moveable between open and closed positions.

4. The bar of claim 3, wherein each of said first and second frame abutments define respective first and second notches, and in the closed state, each of the first and second notches meet to form a respective bar aperture.

5. The bar of claim 4, wherein when each of the first and second notches are in the closed state, said middle section is disposed within the respective bar apertures and each of said first and second frame abutments are immovably fixed to said middle section.

6. The bar of claim 3, wherein when in the open state, the first and second portions form an angle therebetween greater than 15 degrees, and when in the closed state, the first and second portions form an angle therebetween less than 15 degrees.

7. The bar of claim 1, wherein said first and second frame abutments are permanently fixed to said middle portion.

* * * * *